United States Patent [19]

Tholkes

[11] Patent Number: 4,741,547

[45] Date of Patent: May 3, 1988

[54] FOLDING WHEELCHAIR

[76] Inventor: Alan L. Tholkes, 725 10th Ave., Granite Falls, Minn. 56241

[21] Appl. No.: 49,469

[22] Filed: May 14, 1987

[51] Int. Cl.[4] ..... A61G 5/00

[52] U.S. Cl. ..... 280/242 WC; 280/650; 297/45; 297/DIG. 4

[58] Field of Search ..... 280/242 WC, 657, 647, 280/650; 297/DIG. 4, 42, 43, 44, 45

[56] References Cited

U.S. PATENT DOCUMENTS

| | | | |
|---|---|---|---|
| 4,076,304 | 2/1978 | Deucher | 297/45 |
| 4,273,350 | 6/1981 | Williams | 280/242 WC |
| 4,323,133 | 4/1982 | Williams | 280/242 WC |
| 4,595,212 | 6/1986 | Haury | 280/242 WC |
| 4,693,490 | 9/1987 | Loodberg | 280/650 |

*Primary Examiner*—John J. Love
*Assistant Examiner*—Everett G. Diederiks, Jr.
*Attorney, Agent, or Firm*—D. L. Tschida

[57] ABSTRACT

A folding wheelchair frame including a compound folding mechanism having fore and aft tubular hinged wing frames pivotally coupled to the chair's side frames and to a longitudinal tubular slide-follower coordinating assembly. Scissored arms coupled between the forward hinged frame and slide-follower coordinate the folding action relative to the chair's longitudinal center axis and allows the latching thereof. Associated swing-away footrests, removable armrests and latched, folding back frames further reduce the folded profile and facilitate chair usage.

11 Claims, 5 Drawing Sheets

FOLDING WHEELCHAIR

BACKGROUND OF THE INVENTION

The present invention relates to wheelchairs and, in particular, to a novel tubular, hinged frame assembly including a slide-follower fold coordinating assembly, swing-away footrests and a folding back.

Historically, wheelchair designs have remained relatively static in their implementation, even though a variety of accessories have been developed to accommodate various needs of the chair user. The basic chair, however, is typically constructed about tubular side frames which are arranged relative to a scissors-acting folding mechanism to collapse the chair for storage or transport. These folding mechanisms, in turn, most typically are positioned at the approximate center of the chair, beneath the seat, with the hinge action occurring along a vertical transverse plane through the chair. While such a folding action accommodates an attendant pushing the chair from the rear handles, it is inconvenient for the unattended user. That is, the awkward positioning of the folding mechanism makes it difficult for the user to either partially collapse the chair to pass through narrow doorways and/or to completely collapse the chair, such as during entry and egress from an automobile.

As an alternative, therefore, to a vertical-acting folding mechanism, it is desirable that the mechanism be operable in a horizontal plane, and preferably along the longitudinal chair axis. Furthermore, it is preferable that the mechanism be positioned to be accessible by the seated user.

To the extent Applicant is aware of any folding mechanisms of the latter type, descriptions thereof can be found upon references to U.S. Pat. Nos. 4,577,878; 4,101,143; 4,323,133; 4,026,568; and 4,595,212. Of the various designs disclosed therein, probably the most relevant to the present invention are those disclosed in U.S. Pat. Nos. 4,026,568; 4,323,133 and 4,595,212. Each of these discloses a wheelchair frame including a pair of fore and aft hinge assemblies. Each hinge, in turn, comprises a pair of wings, each wing being pivotally secured to the chair side frames, as well as at a point intermediate thereto. Hinge action coordinating assemblies coupled between the frame hinges are also disclosed in the U.S. Pat. No. 4,323,133 and U.S. Pat. No. 4,595,212 patents, with the assembly of the latter patent also including a slide-follower latching mechanism.

While the subject invention bears some similarities to these latter designs, it is believed distinguishable in its combination, along with its novel arrangement of its hinge wings to the chair side frames and center. Hinge action is further controlled via a pair of scissors-acting control arms and concentrically mounted tubular members positioned in slide-follower relation which, along with an associated latch mechanism, provides enhanced accessibility to the seated user. Appurtenant folding back and swing-away footrest assemblies further enhance the ergonomics of the design.

SUMMARY OF THE INVENTION

It is accordingly a primary object of the invention to provide a wheelchair which folds along a horizontal axis into a relatively compact package and which operation may be performed by the seated user without assistance.

It is another object of the invention to provide a pair of folding winged, tubular frame hinges pivotally coupled to the side frames and longitudinally-acting at a center chair axis.

It is still another object of the invention to provide a slide-follower assembly coupled to each hinge frame for coordinating the compound hinge action.

It is a still further object of the invention to provide appurtenant swing-away footrest assemblies to facilitate entry/egress from the chair and/or positioning beneath various furniture.

It is yet another object of the invention to provide a folding back whereby the backrest may be folded into compact relation with the seat frame and a latched hinge mechanism to prevent rearward collapse.

These and still other objects and advantages of the invention are accomplished through the present design of a wheelchair having a pair of symmetrical side frames between which are mounted fore and aft, compound frame wing hinge assemblies. A slide-follower assembly mounted along the center longitudinal axis of the chair and coupled to upright hinge pivots coordinate the chair's folding action.

In the preferred embodiment, the forward hinge assembly includes right and left tubular hinged wing frames, pairs of upper and lower horizontal arm members of each of which are pivotally mounted at their outer end to a tubular side frame member via a common pivot and at their opposite ends to an upright pivot coupled to a lower lying first tubular member of a slide-follower coordinating assembly. Scissor control arms are coupled between the bottoms of the right and left forward wing arm members to the slide-follower assembly.

The aft hinge assembly is similarly comprised of right and left tubular hinged wing frames including upper and lower horizontal arms, although the outer ends of each pair of these arms are coupled to separate pivots mounted above each other along a back upright. Their inner ends are coupled to a second upright pivot at the chair center and to a second longitudinally extending tubular member slidably mounted to the first tubular member.

A linch pin mounts through the slide acting first and second tubular members and secures the folding frame in its most open position. Upon removal, a rearward push on the forward wing frame causes the wing frames to fold inwardly and rearwardly in constrained unison with the co-acting first and second tubular members.

Swing-away, latched footrest members pivotally coupled to the front of each chair frame permit independent control of each footrest. Upper and lower hinge plates coupled to each footrest and pivotally mounted to upper and lower pegged brackets mounted to the chair frame allow the footrests to be swung outward and away from the chair frames. Pivoting latch plates engageable with the upper pegged brackets secure the footrests when rotated to parallel relation to the chair's longitudinal axis. Alternatively, the footrests may be unlatched and removed when not needed.

Split tubular back support members each include a latched hinge assembly. Each hinge comprises a pair of opposed splice plates secured to each back upright and bridging a split therebetween. A tethered latch pin mounts through aligned through holes to latch the back uprights in their erect position and, otherwise, on removal the upper upright portions fold forward about a pivot pin.

Tubular weldments secured to the side frame receive removable arm members.

The above objects, advantages and distinctions of the invention, among others, along with its detailed construction will be described in greater detail hereinafter with respect to the appended drawings. Before referring to the description, it is to be appreciated that the following description is made by way of reference to the presently preferred embodiment only, and should not in any respect be interpreted as self-limiting. That is, various other modifications may be made by those of skill in the art, without departing from the spirit and scope of the invention. To the extent modifications have been considered, they are described as appropriate.

DESCRIPTION OF THE PREFERRED EMBODIMENT

Figure 1:
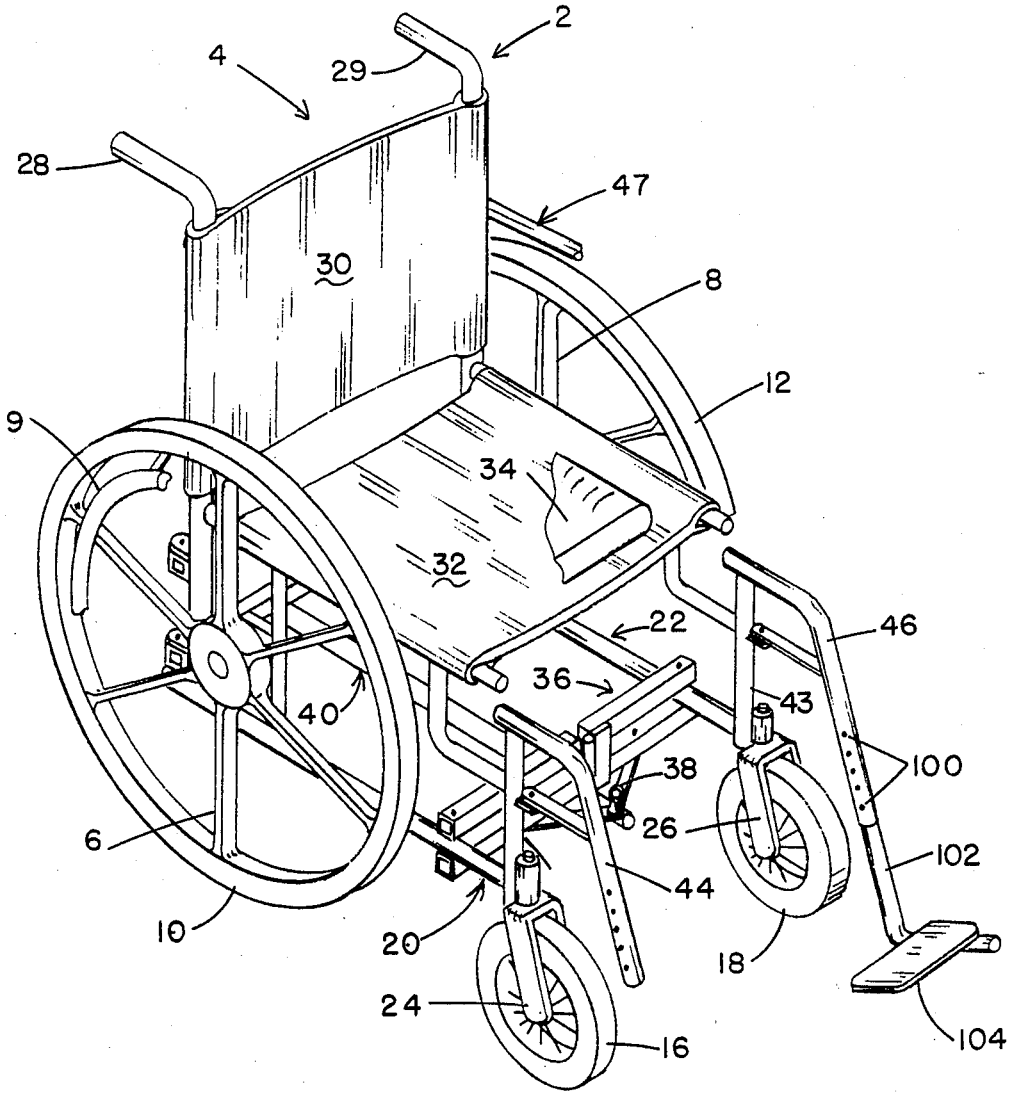
FIG. 1 shows a perspective, partially assembled view of the present wheelchair including the folding frame, folding back, swing-away footrests and removable armrests.

With attention first directed to FIG. 1, a perspective assembly view is shown of the present wheelchair and wherein a number of improvements have been incorporated to facilitate the chair's use by the seated user. In particular, the frame, back and leg rests are hinge constructed to selectively fold during seating/unseating, storage and general use. Narrow doorways, aisleways or the like, in particular, may now be easily traversed by partially collapsing the chair's side frames. These features and others will, however, be described in greater detail hereinafter.

Figure 2:
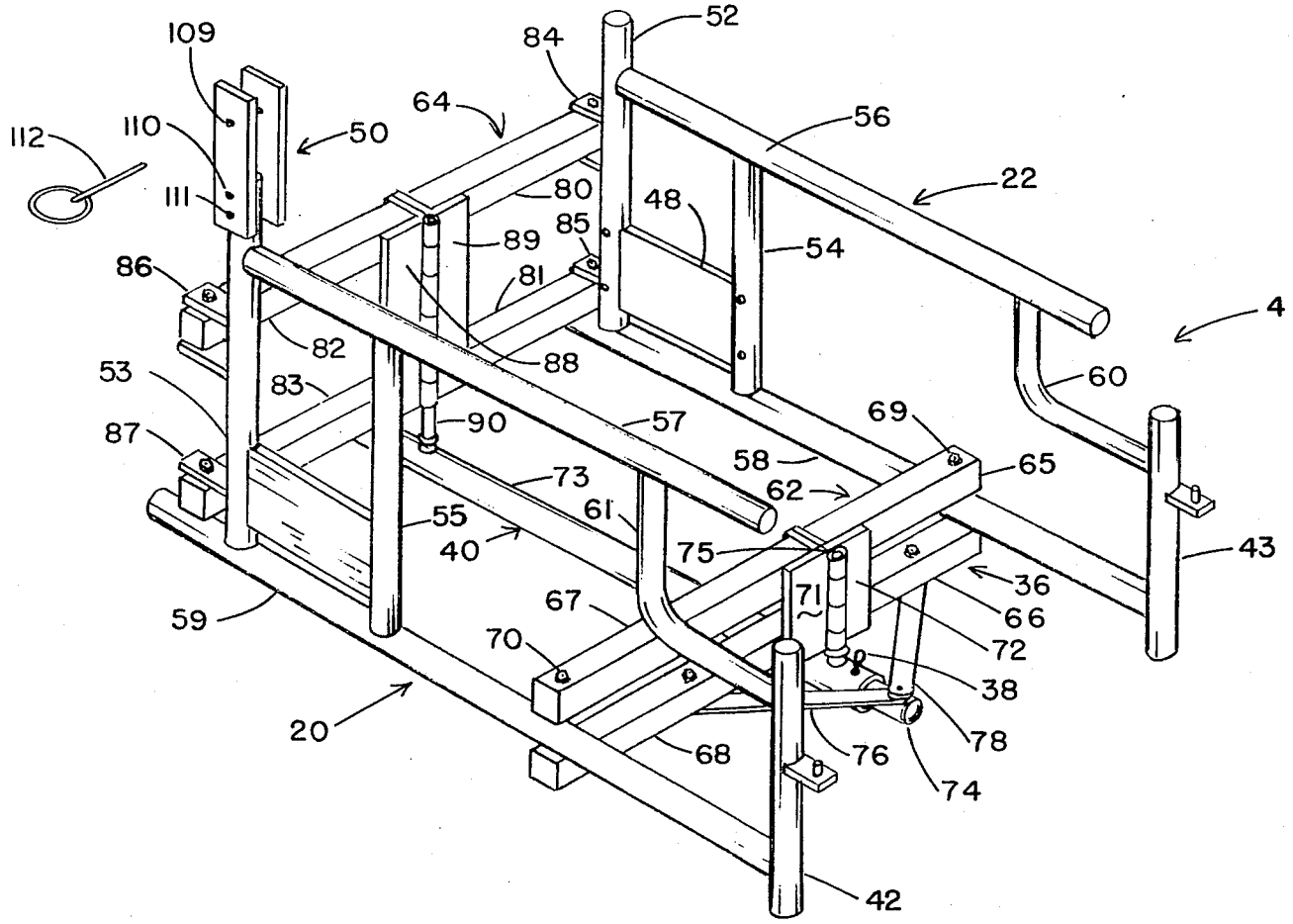
FIG. 2 shows a detailed perspective view of the chair's compound hinge folding mechanism.

Relative to its basic construction, the chair 2 is constructed of a lightweight, stainless steel tubular framework, generally denoted by numeral 4. The framework 4 is supported by a pair of conventional spoked wheels 6 and 8, each containing a hand grip ring 9 and which are supported from axle plates 48 (which are shown in FIG. 2) mounted to the framework 4 and whereto pneumatic tires 10 and 12 are mounted. A pair of spoked, solid tire wheels 16 and 18, in turn, are mounted to the forward end of the respective left and right side frames 20 and 22 to yoked, swivel caster assemblies 24 and 26. In conventional fashion, the user may manipulate the chair via the wheel-mounted hand grips 9 or, alternatively, be pushed by an attendant via the hand holds 28 and 29.

Supported between the left and right side frames 20 and 22 are a sling-mounted back rest 30 and seat 32. Depending upon the user's desires, the back rest 30 and seat 32 may be constructed of various materials, from a variety of fabrics to nylon to leather, so long as the selected material provides a long wear life. A separable foam or air cushion 34 may also be mounted to the sling seat 32 to provide additional comfort. Appreciating, though, the ability of the present chair to fold inwardly to accommodate narrow doorways, such a cushion should be somewhat flexible and narrower than the seat 32. It is also anticipated that the cushion can be more permanently mounted to the seat 32 via Velcro TM fasteners, zippers or the like.

Coupled intermediate the left and right side frames 20 and 22 is a compound hinged framework 36 which, upon release of a user accessible linch pin 38, allows the chair sides 20 and 22 to controllably collapse inwardly toward one another. Narrow doorways or passages may thus be traversed. Handling and/or storage during transport are also facilitated. A centered, longitudinally positioned slide-follower assembly 30 coordinates and stabilizes the hinging action.

Swivel mounted to tubular upright members 42 and 43 at the forward end of each side frame 20 and 22 are upper latched footrest members 44 and 46 which may be individually unlatched from a forwardly directed mounting position and swung to one side or the other. Seating/unseating is thereby facilitated. Alternatively, the chair configuration can be altered to accommodate seating at tables, desks and the like.

The attendant hand hold containing back portions 28 and 29 of each side frame 20 and 22 are further constructed to latch in an upright position, yet be releasable to fold forwardly into proximity to the seat 32. When completely folded, the chair 2 thus collapses into a relatively compact package, only slightly larger than the diameter of the wheels. Such a size facilitates handling by the handicapped user during storage or transport in most conventional automobiles. The armrests 47, if used, may also be removed as desired. It is to be further appreciated that by including an appropriate axle release mechanism, each wheel 6 and 8 may additionally be disassembled to further facilitate handling.

With continuing attention to FIG. 1, additional attention is directed to FIG. 2 and wherein a detailed perspective assembly view is shown of the compound hinged folding framework 36 and slide-follower assembly 40 relative to partially sectioned left and right side frames 20 and 22. Also shown is one of the axle plates 9 and one of the back hinge assemblies 50, which will be described in greater detail relative to FIG. 4.

Before discussing the details of the frame hinge assembly 36, it is to be noted the left and right side chair frames 20 and 22 are each constructed of a number of welded tubular members which are configured into a generally rectangular or parallelogram framework and to which the wheels 10, 12, seat 32 and back 30 are mounted. As mentioned, the forward tubular uprights 42 and 43 support the upper footrest members 44 and 46. Each axle plate 48 is boltably fastened between a lower back upright portion 52 and 53 and an adjacent intermediate upright 54 and 55. Each tubular upright 42, 43, 52, 53, 54 and 55, in turn, is appropriately welded to the upper and lower horizontal tubular members 56, 57 and 58, 59. The sling seat 32 is supported between the upper horizontal members 56 and 57, while the lower members 58 and 59, along with the back uprights 52 and 53, support the about-to-be-described hinge assembly 36.

It is also to be appreciated that the framework 4 may be modified to accommodate a variety of different chair models, wherein one or more of the previously mentioned features are included. That is, assuming a swing-away footrest and folding back assembly are not required, the framework 4 may be modified by deleting the uprights 42 and 43 and intermediate tubular members 60 and 61 and bending the upper horizontal members 56 and 57 forwardly and downwardly to support the length-adjustable footrest. For this embodiment, the front wheel caster assemblies 24 and 26 would be mounted to the sides of the lower horizontal frame members 58 and 59. If a rigid back is desired, the lower back uprights 52 and 53 may be extended upwardly and bent to form the hand holds 28 and 29. In lieu therefore of separately describing each of the possible frameworks 4, it is to be appreciated that modifications can be made to the basic framework 4 to accommodate the variously mentioned improvements described in greater detail hereinafter.

With particular attention now directed to the mechanisms for controlling the chair's folding action, these comprise the compound hinged framework 36 and slide-follower assembly 40. The hinge framework 36 is principally constructed of a pair of fore and aft pairs of horizontal tubular hinged wing frames 62 and 64 which are pivotally supported from the side frames 20 and 22 and to the centered, longitudinal slide-follower assembly 40. In particular, the right and left wings of the forward hinge 62 respectively include pairs of tubular hinge arms 65, 66 and 67, 68. The outer ends of the arms 65, 66 and 67, 68 are pivotally secured via respective pivot pins 69 and 70 to the lower horizontal frame members 58 and 59. The inner ends are welded to the mating right angle halves 71 and 72 of a center hinge, the pivot pin 75 of which is separately welded to a lower longitudinally extending tubular sleeve member 73 of the slide-follower assembly 40.

Extending forwardly and inwardly from each of the lower hinge arms 66 and 68 and coupled to a tubular slide member 74 concentrically mounted in the slide member 73 are a pair of scissored control arms 76 and 78. Mating holes drilled through the tubular members 73 and 74, when the framework 4 is fully expanded, receive the linch pin 38 and latch the assembly in its opened position.

The right and left wings of the aft or rear hinge assembly 64 are similarly comprised of pairs of horizontal tubular hinge arms 80, 81 and 82, 83, the outer ends of which are independently pivotally coupled along the lower back uprights 52 and 53 at pivot brackets 84, 85 and 86, 87 welded thereto. The inner ends are welded to the mating right angle halves 88 and 89 of a center hinge and the pivot pin 90 of which is welded in upright relation to the aft end of the outer slide member 73.

The above described fore and aft hinge assemblies 62 and 64 thus provide a folding action along a longitudinal, vertical plane centered between and parallel to the chair's side frames 20 and 22. The slide-follower assembly 40, in turn, constrains the fore and aft hinge assemblies 62 and 64 to fold in unison, without misalignment, by constraining the hinge action to the slide path defined by the slide members 73 and 74. Because, too, each of the inner ends of the hinge wings 71, 72 and 88, 89 are of a right-angled shape, the opened and closed positions of the chair are defined to exist when the hinge wings mate at the extreme ends of their travel of approximately 90 degrees. That is, when fully opened, the hinge wings contact each other as shown to act as a type of stop; whereas when the chair frame 4 is collapsed, the front numbered faces of the hinge fold into close proximity to one another, with the side frames 20 and 22 being separated only by the intermediate slide members 73 and 74.

With the foregoing front accessible construction, it is to be appreciated the seated user is now able, without undue difficulty, to access the folding mechanism 36 to partially or completely collapse the chair 2. Before, most available folding mechanisms were either awkwardly positioned or only accessible from the rear of the chair, thus complicating the user's day-to-day activities.

Figure 3:
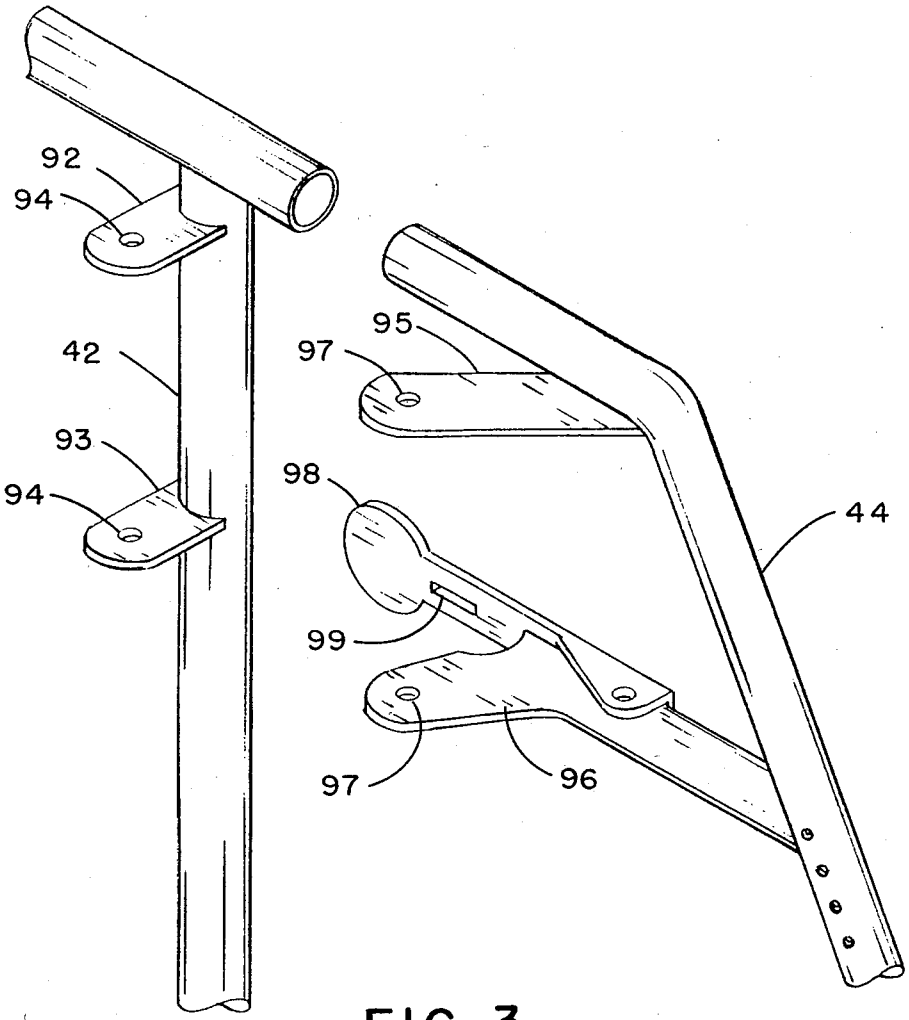
FIG. 3 shows a detailed perspective view of one of an alternative embodiment of the swing-away footrests.

With attention next directed to FIG. 3, a detailed perspective view is shown of an alternative embodiment of the left footrest assembly 44, which is coupled to the tubular upright member 42. This assembly acts the same as that previously disclosed, but provides enhanced stability and locking. In particular, it includes a pair of upper and lower hinge plates 92 and 93 which are welded to the upright 42 and each of which support a pivot pin 94 at their outer end. Mating upper and lower hinge plates 95 and 96, welded to the footrest member 44, in turn, each contain holes 97 which receive the pins 94. Together the plate pairs 92, 95 and 93, 96 act as hinges for the footrest members 44 and 46 and allow the footrests to be pivoted either inwardly or outwardly as desired, to facilitate seating and/or positioning of the chair 2 beneath a table, desk or the like.

Pivotally mounted to the inner edge of each lower hinge plate 96 is a latch member 98 which includes an end slot 99 that mounts about a tipped portion of hinge plate 93 to latch the assembly when the footrest member 44 parallels the longitudinal chair axis. Also provided at the lower end of each of the footrest member 44 are a number of adjustment holes 100, which may be aligned with a number of mating holes provided in the lower footrest member 102 (see FIG. 1) to adjust the overall length of the assembly to accommodate the user. A swivel-mounted platform 104, mounted to the end of the arm 102, may be raised and lowered as appropriate.

Figure 4:
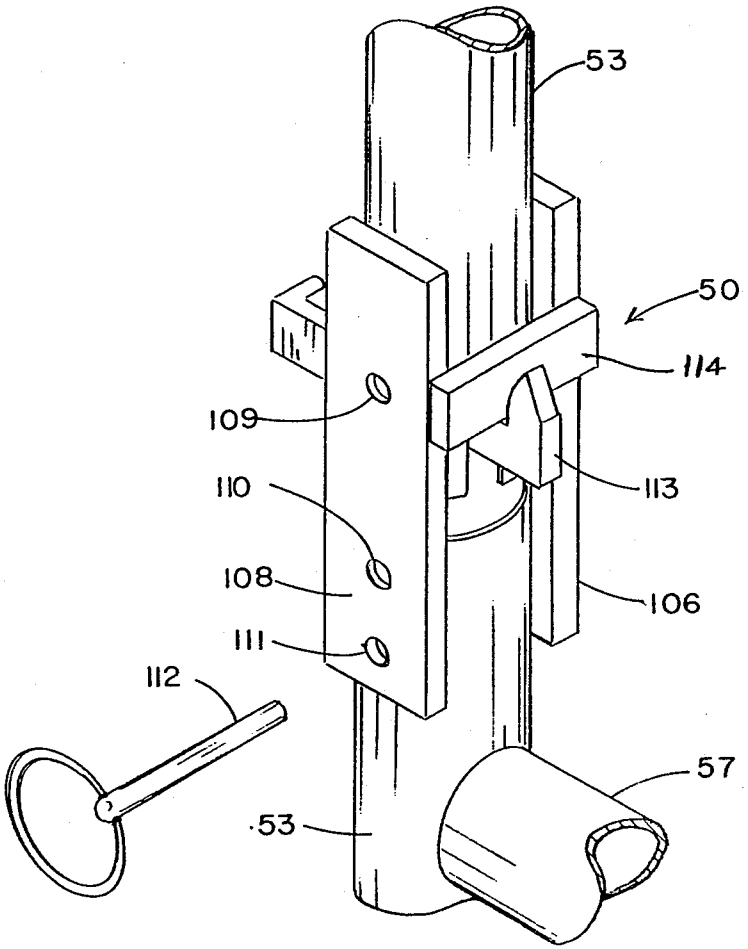
FIG. 4 shows a detailed perspective view of one of the back upright hinge assemblies.

With continuing attention to FIG. 2 and particular attention to FIG. 4, alternative embodiments are shown of back upright hinge assemblies 50. For those chair frames 4 where a folding back is desired, the chair back uprights 52 and 53 are each cut off slightly above the horizontal members 56 and 57 and drilled to receive one of the hinge assemblies 50.

In particular, for the embodiment of FIG. 2, each hinge assembly 50 comprises a pair of flat splice plate members 106 and 108 having a number of drilled holes at their upper and lower ends. Holes 109 and 110 receive through bolts, with the bolt through hole 110 acting as a pivot point for the backrest 30. Hole 111, in turn, acts to receive a linch pin 112, which latches the assembly in its most upright position.

In the embodiment of FIG. 4, a notched latch member 113 is pivotally secured at hole 109 via its through bolt within a split end of the upright 53. The front tip of the latch selectively engages a cross-arm member 114 mounted between the splice plates 106 and 108. The rear end of the latch 113 is bent at ninety degrees and extends behind the upright 53 to prevent reverse rotation. That is, with the upright 53 in its vertical position, the latch 113 may normally be rotated up and down to engage and disengage it from the cross-arm member 114. However, regardless of the latch position, any attempt to rotate the upright 53 rearwardly rotates the latch to engage the cross-arm member 114. Thus, the embodiment of FIG. 4 provides for a single direction pivot latch assembly 50 only, whereas the back of the embodiment of FIG. 1 can be rotated rearward.

Figure 5:
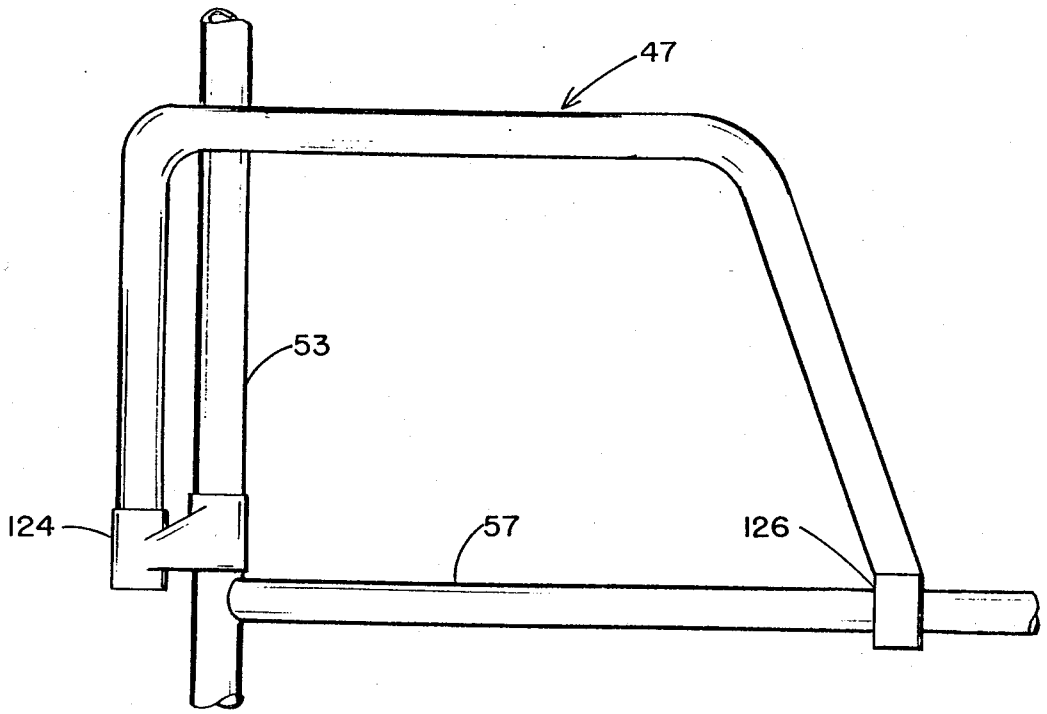
FIG. 5 shows a front elevation view of one of the removable arms.

Attention is lastly directed to FIG. 5 and wherein one of the detachable arm rests 47 of FIG. 1 is shown relative to the side frame 22 and frame members 53 and 57. In lieu of permanently attaching each arm rest 47 to the side frames, tubular weldments 124 and 126 are secured to the side frames to receive the mating extreme ends of the arm rests 47. Thus, the arm rests 47 may be added or removed by merely inserting the ends in the couplers 124 and 126.

While the foregoing invention has been described with respect to its presently preferred embodiment and various contemplated modifications, still other modifications may be made thereto by those of skill in the art without departing from the spirit and scope of the invention. It is accordingly contemplated that the following claims should be interpreted to include all those equivalent embodiments within the spirit and scope thereof.

What is claimed is:

1. A folding wheel chair frame comprising:

(a) first and second tubular frame assemblies mountable in generally planar parallel relation to one another each having;

(1) a back upright member, the uppermost end of which is bent to provide a hand-hold, (2) a front upright member, (3) an upper horizontal seat attachment member, and (4) a lower horizontal front caster attachment member, said front and back upright and said upper and lower horizontal members coupled to one another in a generally parallelogram framework;

(b) a front hinge assembly comprising first and second tubular wings, each wing having a pair of upper and lower horizontal members the outermost ends of which members are pivotally mounted via first and second pivots to said respective first and second frames adjacent said front uprights and the innermost ends of which are coupled to one of a front pair of mating right angled hinge plates, said front pair of mating right angled hinge plates being pivotally interconnected by a front hinge pivot pin;

(c) a rear hinge assembly comprising third and fourth tubular wings, each wing having a pair of upper and lower horizontal members, the outermost ends of which members are independently pivotally mounted to the back upright of said first and second frames and the innermost ends of which are coupled to one of a rear pair of mating right angle hinge plates, said rear paid of mating right angled hinged plates being pivotally interconnected by a rear hinge pivot pin;

(d) a first longitudinally positioned tubular slide member;

(e) a second longitudinally positioned tubular slide member slidably mounted to said first slide member; and (f) said front and rear hinge pivot pins each being mounted in vertical relation to said first and second slide members and each pivot pin having one end thereof fixedly attached to said second tubular slide member, whereby relative longitudinal movement of said first and second slide members causes pivoting of said hinge assemblies thereby folding said wheelchair.

2. Apparatus as set forth in claim 1 wherein said first and second slide members are concentrically mounted to one another along the longitudinal center of the chair frame.

3. Apparatus as set forth in claim 1 including first and second arm members, each pivotally coupled to one of the lower horizontal front wing members and to one of said longitudinal slide members.

4. Apparatus as set forth in claim 1 wherein when said chair frame is fully expanded, holes through the front end of said first and second slide members align to receive a locking linch pin therethrough, said linch pin being accessible to a seated user.

5. Apparatus as set forth in claim 1 including:

(a) a pair of bent tubular upper footrest members, each having a horizontal portion and a downwardly sloping forward portion, each including a pivot member mounted orthogonally to said upper horizontal portion and mountable in one of said front uprights and a second horizontal member extending rearward along said sloping portion; and (b) means for latching each of said footrest members in fixed forward directed relation to one of said frame assemblies in a lowered position and releasing said footrest member to pivot freely in a raised position.

6. Apparatus as set forth in claim 5 wherein said latch means comprises a pivot pin containing member mounted to said front upright and said second horizontal member includes a hole receiving said pin when said footrest member is in its lowered position.

7. Apparatus as set forth in claim 1 wherein the back upright of each of said first and second tubular frame assemblies is severed slightly above said seat attachment member and includes latch means pivotally bridging said severed portions for selectively securing each back upright in a fixed upright position and pivotally releasing said back upright to rotate forwardly into substantially parallel relation to said seat attachment member.

8. Apparatus as set forth in claim 7 wherein said latch means of each back upright comprises:

(a) a pair of flat stock members mounted in opposed bridging relation to said severed uprights;

(b) a cross member edge mounted between said flat stock members;

(c) a pivot member pivotally mounted to one of said flat stock members and having an upright tang at one end and a right angle bend at its other end, said upright tang positioned to engage said cross member and said right angle bend positioned to engage the back of said back upright member.

9. A folding wheel chair frame comprising:

(a) first and second tubular frame assemblies mountable in generally planar parallel relation to one another each having;

(1) a back upright member, the uppermost end of which is bent to provide a hand-hold, (2) a front upright member, (3) an upper horizontal seat attachment member, and (4) a lower horizontal front caster attachment member, said front and back upright and said upper and lower horizontal members coupled to one another in a generally parallelogram framework;

(b) a front hinge assembly comprising first and second tubular wings, each wing having a pair of upper and lower horizontal members the outermost ends of which members are pivotally mounted via first and second pivots to said respective first and second frames adjacent said front uprights and the innermost ends of which are coupled to one of a front pair of mating right angled hinge plates, said front pair of mating right angled hinge plates being pivotally interconnected by a front hinge pivot pin;

(c) a rear hinge assembly comprising third and fourth tubular wings, each wing having a pair of upper and lower horizontal members, the outermost ends of which members are independently pivotally mounted to the back upright of said first and second frames and the innermost ends of which are coupled to one of a rear pair of mating right angle hinge plates, said rear paid of mating right angled hinge plates being pivotally interconnected by a rear hinge pivot pin;

(d) a first longitudinally positioned tubular slide member;

(e) a second longitudinally positioned tubular slide member concentrically mounted to said first slide member;

(f) said front and rear hinge pivot pins each being mounted in vertical relation to said first and second slide members and each pivot pin having one end thereof fixedly attached to said second tubular slide member, whereby relative longitudinal movement of said first and second slide members causes pivoting of said hinge assemblies thereby folding said wheelchair; and (g) first and second arm members, each pivotally coupled to one of the lower horizontal front wing members and to said first longitudinal slide member wherein when said chair frame is fully expanded, holes through the front end of said first and second slide members align to receive a locking linch pin therethrough.

10. Apparatus as set forth in claim 9 including:

(a) a pair of bent tubular upper footrest members, each having a horizontal portion and a downwardly sloping forward portion, each including a pivot member mounted orthogonally to said upper horizontal portion and mountable in one of said front uprights and a second horizontal member extending rearward along said sloping portion; and (b) means for latching each of said footrest members in fixed forward directed relation to one of said frame assemblies in a lowered position and releasing said footrest member to pivot freely in a raised position.

11. Apparatus as set forth in claim 10 wherein the back upright of each of said first and second tubular frame assemblies is severed slightly above said seat attachment member and includes latch means pivotally bridging said severed portions for selectively securing each back upright in a fixed upright position and pivotally releasing said back upright to rotate forwardly into substantially parallel relation to said seat attachment member.

* * * * *